US007892410B2

(12) United States Patent
Goto et al.

(10) Patent No.: US 7,892,410 B2
(45) Date of Patent: Feb. 22, 2011

(54) DISCHARGE SURFACE TREATMENT METHOD AND DISCHARGE SURFACE TREATMENT APPARATUS

(75) Inventors: Akihiro Goto, Tokyo (JP); Masao Akiyoshi, Tokyo (JP); Katsuhiro Matsuo, Aichi (JP); Hiroyuki Ochiai, Tokyo (JP); Mitsutoshi Watanabe, Tokyo (JP); Takashi Furukawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 1280 days.

(21) Appl. No.: 10/559,344

(22) PCT Filed: Feb. 9, 2004

(86) PCT No.: PCT/JP2004/001318

§ 371 (c)(1),
(2), (4) Date: Apr. 20, 2006

(87) PCT Pub. No.: WO2004/108988

PCT Pub. Date: Dec. 16, 2004

(65) Prior Publication Data

US 2006/0213777 A1 Sep. 28, 2006

(30) Foreign Application Priority Data

Jun. 4, 2003 (JP) ..... 2003-158896

(51) Int. Cl.
*C25D 21/12* (2006.01)

(52) U.S. Cl. ..... 205/83; 204/164; 219/69.11

(58) Field of Classification Search ..... 205/83
See application file for complete search history.

(56) References Cited

U.S. PATENT DOCUMENTS 4,236,057 A * 11/1980 Inoue ..... 219/69.13

(Continued)

FOREIGN PATENT DOCUMENTS

CN 1272144 A 11/2000

(Continued)

OTHER PUBLICATIONS

Machine translation of JP 3271836.*

(Continued)

*Primary Examiner*—Harry D Wilkins, III
*Assistant Examiner*—Bryan D. Ripa
(74) *Attorney, Agent, or Firm*—Sughrue Mion, PLLC

(57) ABSTRACT

To form a thick coating by a discharge surface treatment, a voltage between an electrode and a workpiece during a discharge is detected, and it is determined that a discharge surface treatment state is abnormal if it is detected that the voltage is reduced. With this arrangement, it is possible to accurately detect an unstable phenomenon in the discharge surface treatment, and take appropriate measures before a state of the coating and a state of the electrode are worsened due to the unstable phenomenon. By discriminating a stability of the discharge surface treatment, the coating and the electrode are prevented from being damaged.

20 Claims, 6 Drawing Sheets

U.S. PATENT DOCUMENTS

| | | | | |
|---|---|---|---|---|
| 4,700,038 | A * | 10/1987 | Dauw | 219/69.18 |
| 4,800,248 | A * | 1/1989 | Futamura et al. | 219/69.18 |
| 6,602,561 | B1 | 8/2003 | Moro et al. | |
| 6,702,896 | B1 * | 3/2004 | Inoue et al. | 118/638 |
| 2002/0000369 | A1 * | 1/2002 | Mohri et al. | 204/192.12 |
| 2005/0098541 | A1 * | 5/2005 | Mohri et al. | 219/69.18 |

FOREIGN PATENT DOCUMENTS

| | | | |
|---|---|---|---|
| JP | 5-148615 | A | 6/1993 |
| JP | 7-070761 | A | 3/1995 |
| JP | 8-300227 | A | 11/1996 |
| JP | 8-323544 | A | 12/1996 |
| JP | 11-233233 | | 8/1999 |
| JP | 2001-034227 | | 2/2001 |
| WO | WO 99/58744 | A1 | 11/1999 |
| WO | WO 9958743 | A1 * | 11/1999 |
| WO | WO 01/05545 | A1 | 1/2001 |
| WO | WO 01/23640 | A1 | 4/2001 |

OTHER PUBLICATIONS

A. Goto, et al, "Formation of Hard Layer on Metallic Material by EDM", Proc. International Symposium for Electro-Machining (ISEM 12), 1998, pp. 271-278.

A. Goto, et al, "Development of Electrical Discharge Coating Method", Proc. International Symposium for Electro-Machining (ISEM 13) pp. 581-588.

* cited by examiner

DISCHARGE SURFACE TREATMENT METHOD AND DISCHARGE SURFACE TREATMENT APPARATUS

TECHNICAL FIELD

The present invention relates to a technology for discharge surface treatment, and more particularly, to a discharge surface treatment method and a discharge surface treatment apparatus for generating a pulse-like discharge between an electrode and a workpiece, using a green compact electrode formed by compressing metal powder, metal compound powder, or ceramics powder as an electrode, and forming a coating consisting of either an electrode material or a matter obtained by causing the electrode material to react by a discharge energy on a surface of the workpiece.

BACKGROUND ART

In a conventional discharge surface treatment, an attention is mainly paid to wear resistance at an ordinary temperature, and a coating consisting of a hard material such as titanium carbide (TiC) is formed (see, for example, Patent Document 1).

Patent Document 1: International Publication No 99/85744 pamphlet

However, a demand for not only forming the hard ceramics coating intended to ensure a high wear resistance at the ordinary temperature but also for forming a coating as thick as 100 μm or more is getting stronger. Functions required for the thick coating include wear resistance and lubricity under high temperature environment. The thick coating having these functions is formed for a component used under a high temperature environment.

To form such a thick coating, an electrode formed by compressing powder mainly consisting of metal powder and, if necessary, subjecting the compressed powder to a heat treatment is used. The electrode differs from the electrode mainly consisting of ceramics and used to form the hard ceramic film.

To form a thick coating by a discharge surface treatment, it is necessary for the electrode to have predetermined properties such as a somewhat low hardness. This is because it is necessary to supply a large amount of the electrode material to the workpiece by discharge pulses.

Although a coating is normally stably formed by the discharge surface treatment, the state of forming a coating could suddenly turn unstable, and once this happens, it is impossible to restore a stable state. The reasons are considered as follows. The sudden occurrence of the unstable state results from concentration of discharge. Once the state turns unstable, a part of the electrode on which the discharge concentrates is widely molten and resolidified. If the part of the electrode is molten, an electrode form of the part is deformed and a discharge is apt to occur to the part.

A discharge surface treatment method according to one aspect of the present invention is for generating a pulse-like discharge between an electrode and a workpiece, using a green compact formed by compressing any one of a metal powder, a metal compound powder, and a ceramics powder as the electrode, and forming a coating consisting either one of a material for the electrode and a material obtained from a reaction of the material for the electrode by a discharge energy of the pulse-like discharge on a surface of the workpiece. The discharge surface treatment method includes detecting a voltage between the electrode and the workpiece during a discharge; and determining that a state of the discharge surface treatment is abnormal if the voltage is lower than a possible predetermined value of a sum of an arc voltage and a voltage drop of the electrode during a discharge in which melting of a local part of the electrode due to concentration of the discharge or resolidification of the local part subsequent to the melting does not occur.

According to the present invention, a voltage between the electrode and the workpiece during the discharge is detected, and it is determined that a discharge surface treatment state is abnormal if it is detected that the voltage is lower than a possible predetermined value of a sum of an arc voltage and a voltage drop of the electrode during the discharge, during which melting of a local part of the electrode due to concentration of the discharge or resolidification of the local part subsequent to the melting does not occur. Thus, an unstable phenomenon is accurately detected during the discharge surface treatment. It is therefore possible to take appropriate measures before the coating film formation state and the electrode state are worsened due to the unstable phenomenon in the discharge surface treatment. Namely, by discriminating the stability of the discharge surface treatment, the coating film and the electrode can be prevented from being damaged.

The present invention has been achieved to solve the conventional problems. It is an object of the present invention to provide a discharge surface treatment method and a discharge surface treatment apparatus that can accurately detect an unstable phenomenon in forming a coating, and that can take appropriate measures before a coating state and an electrode state are worsened due to the unstable phenomenon.

DISCLOSURE OF INVENTION

A discharge surface treatment method according to one aspect of the present invention is for generating a pulse-like discharge between an electrode and a workpiece, using a green compact formed by compressing any one of a metal powder, a metal compound powder, and a ceramics powder as the electrode, and forming a coating consisting either one of a material for the electrode and a material obtained from a reaction of the material for the electrode by a discharge energy of the pulse-like discharge on a surface of the workpiece. The discharge surface treatment method includes detecting a voltage between the electrode and the workpiece during a discharge; and determining that a state of the discharge surface treatment is abnormal if a drop of the voltage is detected.

According to the present invention, an unstable phenomenon is accurately detected during a discharge surface treatment. Therefore, it is possible to take appropriate measures before the coating formation state and the electrode state are worsened due to the unstable phenomenon in the discharge surface treatment. Namely, by discriminating a stability of the discharge surface treatment, damages on the coating and the electrode can be prevented.

BEST MODE(S) FOR CARRYING OUT THE PRESENT INVENTION

Exemplary embodiments of the present invention will be explained in detail below with reference to the accompanying drawings. It should be noted that the present invention is not limited to the exemplary embodiments and changes and modifications can be appropriately made to the present invention within the scope of the gist of the present invention. In addition, for facilitating understanding, scales of respective members may differ in the accompanying drawings.

A technical concept or forming a thicker coating by a discharge surface treatment will first be explained.

It has been found that if an electrode formed by using a material that mainly consists of a metal component is used as an electrode and an oil is used as a machining fluid to form the thicker coating by the discharge surface treatment, and if a large amount of a material that tends to form a carbide is contained in the electrode, the material that tends to form the carbide reacts with carbon contained in the oil as the machining fluid, and therefore, a thicker coating is difficult to form.

A study by the inventors shows that if a coating is formed by an electrode manufactured using powder of about several μm, it is difficult to stably form an elaborate thick coating unless a material such as Co (cobalt), Ni (nickel), or Fe (iron) by which it is difficult to form carbides, is contained in the electrode.

Depending on a particle diameter, a quality, and the like of the powder to be used, it is necessary to include the material that makes it difficult to form carbides by 40 volume % or more so as to form a thick coating. If the material that makes it difficult to form carbides is contained in the electrode by 40 volume % or more, an elaborate thick coating can be stably formed. If the particle diameter is smaller than 1 μm, the thick coating can be sometimes formed without containing such a material in the electrode.

Figure 1:
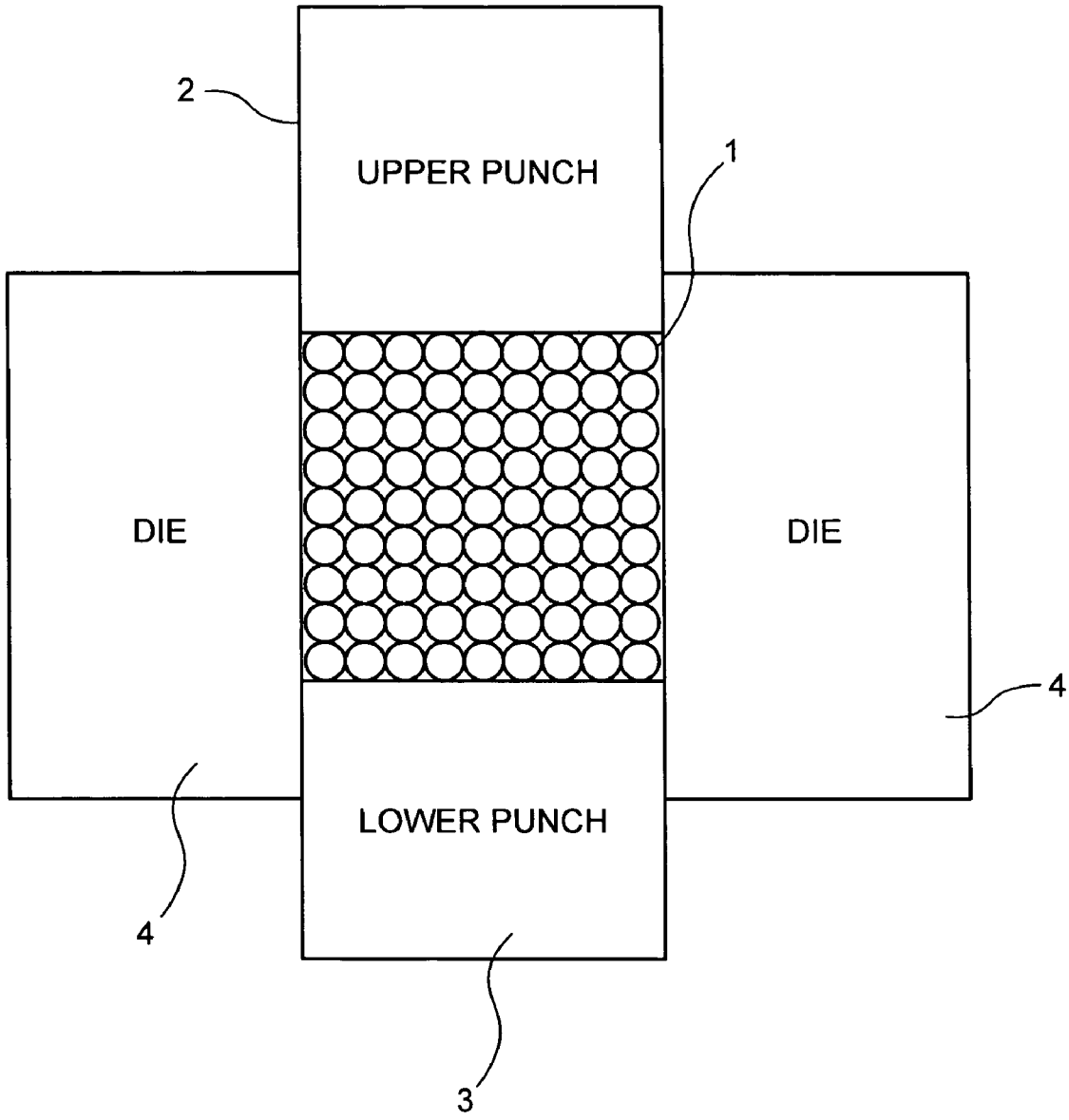
FIG. 1 is a schematic for illustrating a process of manufacturing an electrode for discharge surface treatment.

A discharge surface treatment method according to the present embodiment will next be explained. FIG. 1 is a schematic for illustrating a concept of a method for manufacturing an electrode for discharge surface treatment according to a first embodiment of the present invention. With reference to FIG. 1, an example of using a Co alloy powder for a material for an electrode as an example of an electrode employed in the present invention will be explained. In FIG. 1, Co alloy powder 1 is filled up into a space surrounded by an upper punch 2 of a mold, a lower punch 3 of the mold, and a die 4 of the mold. By compressing this Co alloy powder 1, a green compact is formed. In the discharge surface treatment, this green compact serves as a discharge electrode.

Steps of manufacturing the electrode shown in FIG. 1 are as follows. The Co alloy powder 1 is filled in the mold, and pressed by the upper punch 2 and the lower punch 3. By thus applying a predetermined pressing pressure to the Co alloy powder 1, the Co alloy powder 1 is solidified into a green compact.

At the time of pressing, if wax such as paraffin is mixed into the Co alloy powder 1 to improve transmission of the pressing pressure into an interior of the Co alloy powder 1, a formability of the Co alloy powder 1 can be improved. However, if a residual amount of the wax in the electrode is larger, an electric conductivity is deteriorated accordingly. It is, therefore, preferable to remove the wax at a later step if the wax is mixed into the Co alloy powder 1.

The green compact thus formed by compressing the Co alloy powder 1 can be employed as the electrode for discharge surface treatment without processing it if the green compact has a predetermined hardness by the compression. If the green compact does not have the predetermined hardness, a strength, i.e., the hardness of the green compact can be intensified by heating the green compact.

Figure 2:
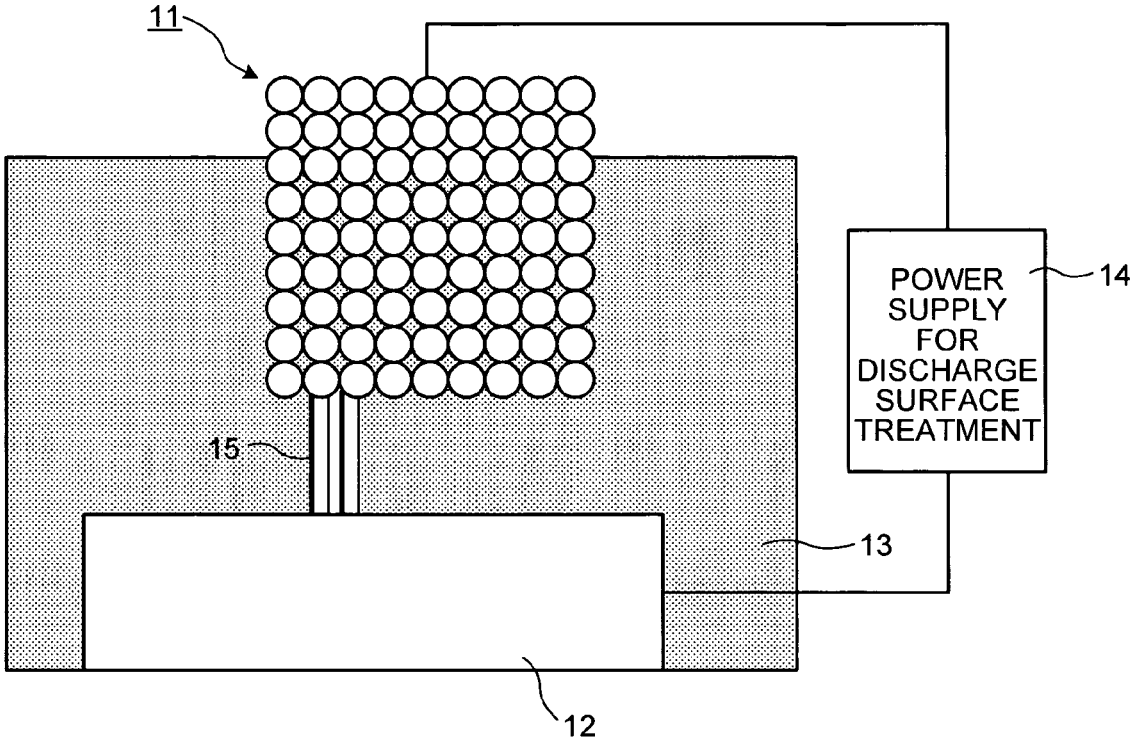
FIG. 2 is a schematic for illustrating a discharge surface treatment by a discharge surface treatment apparatus using the electrode for discharge surface treatment for forming a thick film.
Figure 3:
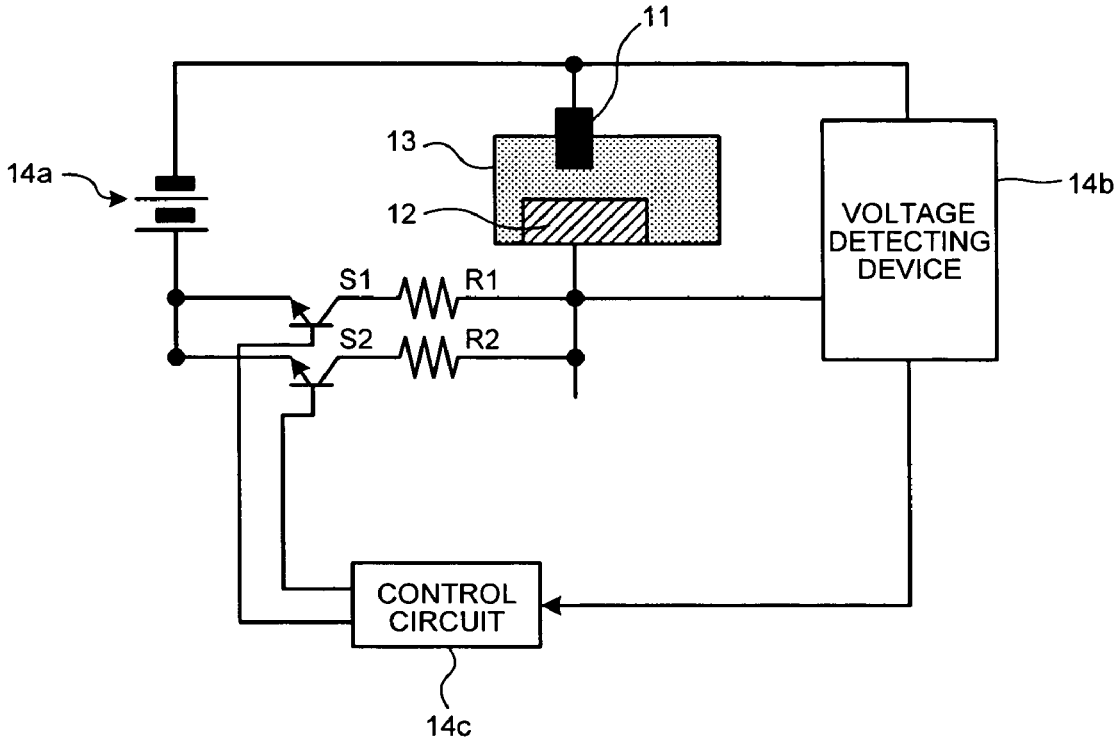
FIG. 3 is a circuit diagram of an electric circuit used in the discharge surface treatment shown in FIG. 2.

FIG. 2 is a conceptual view of a state in which the discharge surface treatment is performed by a discharge surface treatment apparatus according to the present invention that employs the electrode for discharge surface treatment for forming a thick coating manufactured through these steps, and having the low hardness. FIG. 2 depicts a state in which a pulse-like discharge is generated. FIG. 3 is a circuit diagram of an electric circuit used in the discharge surface treatment shown in FIG. 2.

As shown in FIG. 2, the discharge surface treatment apparatus according to this embodiment includes an electrode for discharge surface treatment 11 (hereinafter, "electrode 11") that is equal to the electrode for discharge surface treatment shown in FIG. 1, and that consists of the green compact formed by compressing the Co alloy powder 1 or a green compact formed by heating the green compact, an oil as a machining fluid 13, and a power supply for discharge surface treatment 14 that generates a pulse-like discharge (an arc column 15) by applying a voltage between the electrode 11 and a workpiece 12.

The power supply for discharge surface treatment 14 includes a power supply main body 14*a*, a voltage detecting device 14*b*, switching elements S1, S2, and the like, resistors R1, R2, and the like connected to the respective switching elements S1, S2, and the like, and a control circuit 14*c* that turns on or off the respective switching elements S1, S2, and the like shown in FIG. 3. In FIG. 3, the constituent elements of the power supply for discharge surface treatment 14 are shown separate from one another for facilitating understanding.

Members of the power supply for discharge surface treatment, such as a driver that controls a relative positional relationship between the electrode 11 and the workpiece 12, a machining fluid tank that stores the machining fluid 13, and the like, which are of no direct relation to the present invention are not shown in FIG. 3. To form a coating on a surface of the workpiece by this discharge surface treatment apparatus, the electrode 11 and the workpiece 12 are arranged to face each other in the machining fluid 13. In the machining fluid, a pulse-like discharge is generated between the electrode 11 and the workpiece 12 using the power supply for discharge surface treatment. Specifically, a voltage is applied between the electrode 11 and the workpiece by turning on and off the switching element S1 or S2 by the control circuit 14*c*, thereby generating the discharge. The discharge arc column 15 is generated between the electrode 11 and the workpiece 12 as shown in FIG. 2.

The switching element to be turned on and off is determined by a current flow when the discharge is generated. Specifically, in FIG. 3, the switching elements are connected to the respective resistors each having a preset resistance. If a discharge is generated while each switching element is turned on, a current determined by the resistances and a voltage of the power supply flows. If the discharge is generated while a plurality of switching elements is turned on, a current that is a sum of the respective currents flows.

If the voltage of a DC power supply is represented by E and a voltage between electrodes is represented by Vg, the current when the switching element S1 is turned on is (E−Vg)/R1. Likewise, the current when the switching element S2 is turned on is (E−Vg)/R2. The current when the switching elements S1 and S2 are simultaneously turned on is (E−Vg)/R1+(E−Vg)/R2.

The circuits of the present invention are intended to limit the current by the resistors. Alternatively, a circuit system for setting the current flow to a desired value may be used.

A coating consisting of an electrode material is formed on the surface of the workpiece by a discharge energy of the discharge generated between the electrode 11 and the workpiece 12, or a coating consisting of a matter obtained by provoking a reaction of the electrode material by the discharge energy is formed thereon. It is assumed herein that the electrode 11 has a negative polarity and that the workpiece 12 has a positive polarity.

Figure 4A:
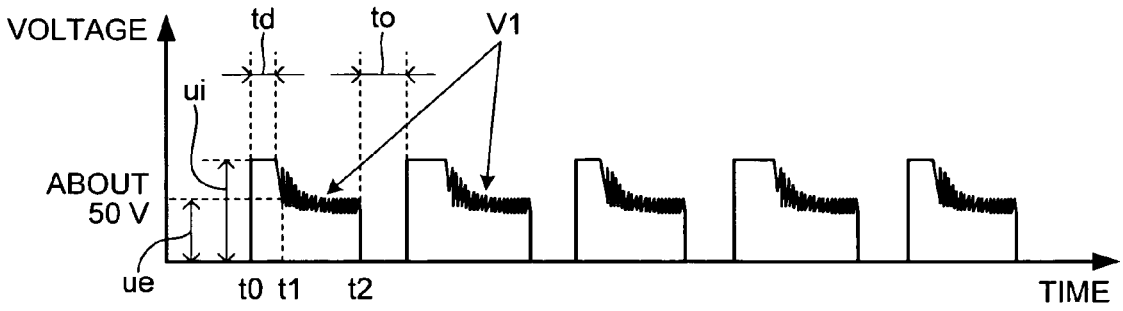
FIG. 4A is a graph of a voltage waveform when the discharge surface treatment is normally performed.
Figure 4B:
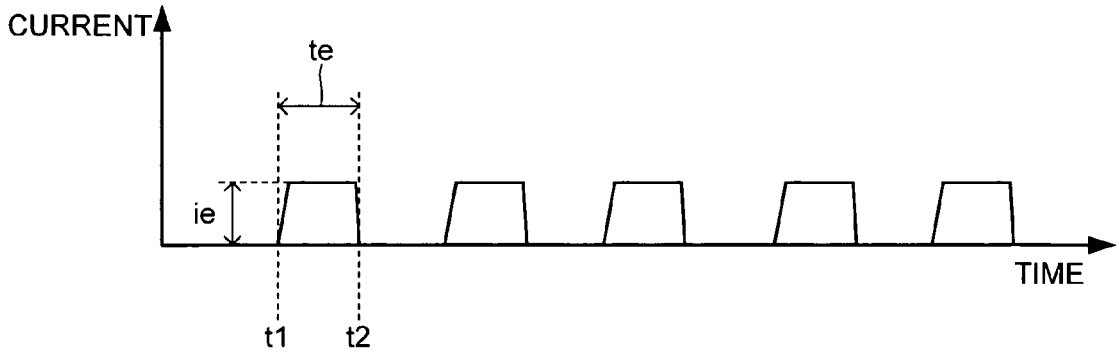
FIG. 4B is a graph of a current waveform corresponding to the voltage waveform shown in FIG. 4A.

FIGS. 4A and 4B depict an example of pulse conditions for the discharge if the discharge surface treatment apparatus having such a circuit arrangement performs the discharge surface treatment. FIGS. 4A and 4B depict one example of pulse conditions for the discharge during the discharge surface treatment. FIG. 4A is a graph of a voltage waveform applied between the electrode 11 and the workpiece 12 during the discharge. FIG. 4B is a graph of a current waveform flow to the discharge surface treatment apparatus during the discharge. As shown in FIG. 4A, a no-load voltage ui is applied between the anode and the cathode at a time t0. At a time t1 after passage of a discharge delay time td, a discharge is generated therebetween and a current flows. The voltage applied at this time is a discharge voltage ue and the current at this time is a peak current ie. If application of the voltage between the anode and the cathode is stopped at a time t2, no current flows.

A period (t2−t1) is referred to as "pulse width te". The voltage having the voltage waveform from the time t0 to the time t2 is repeatedly applied between the anode and the cathode at intervals of quiescent time to. As shown in FIG. 4A, a pulsed voltage is applied between the electrode 11 and the workpiece 12.

If the discharge surface treatment is normally performed, the discharge voltage is about 50 volts in a range of 40 to 60 volts. It is noted, however, that the voltage slightly varies depending on various conditions such as forming conditions for the electrode 11.

If the electrode 11 is formed to have a high hardness, the voltage applied between the electrode 11 and the workpiece 12 is low. If the electrode 11 is formed to have a low hardness, the voltage applied between the electrode 11 and the workpiece 12 is high.

A reason for this phenomenon is as follows. The voltage between the electrode 11 and the workpiece 12, that is, the arc voltage itself is normally about 25 to 30 volts. However, the thick coating formation electrode 11 employed in the present invention is manufactured by compressing the powder, therefore, the electrode 11 has a high electric resistance.

Thus, a measurement result of the voltage detecting device 14*b* shown in FIG. 3 is a voltage obtained by adding a voltage drop of the electrode 11 to the arc voltage, which voltage is high, as compared with when the electrode has a low electric resistance.

If the thick coating is thus formed stably by the discharge surface treatment, the detected voltage between the anode and the cathode during the discharge, i.e., a voltage V1 between the electrode 11 and the workpiece 12 is high as shown in FIG. 4A. If the thick coating cannot be formed stably, the detected voltage between the anode and the cathode during the discharge, i.e., the voltage V1 between the electrode 11 and the workpiece 12 is reduced as shown in FIG. 5A.

Figure 6:
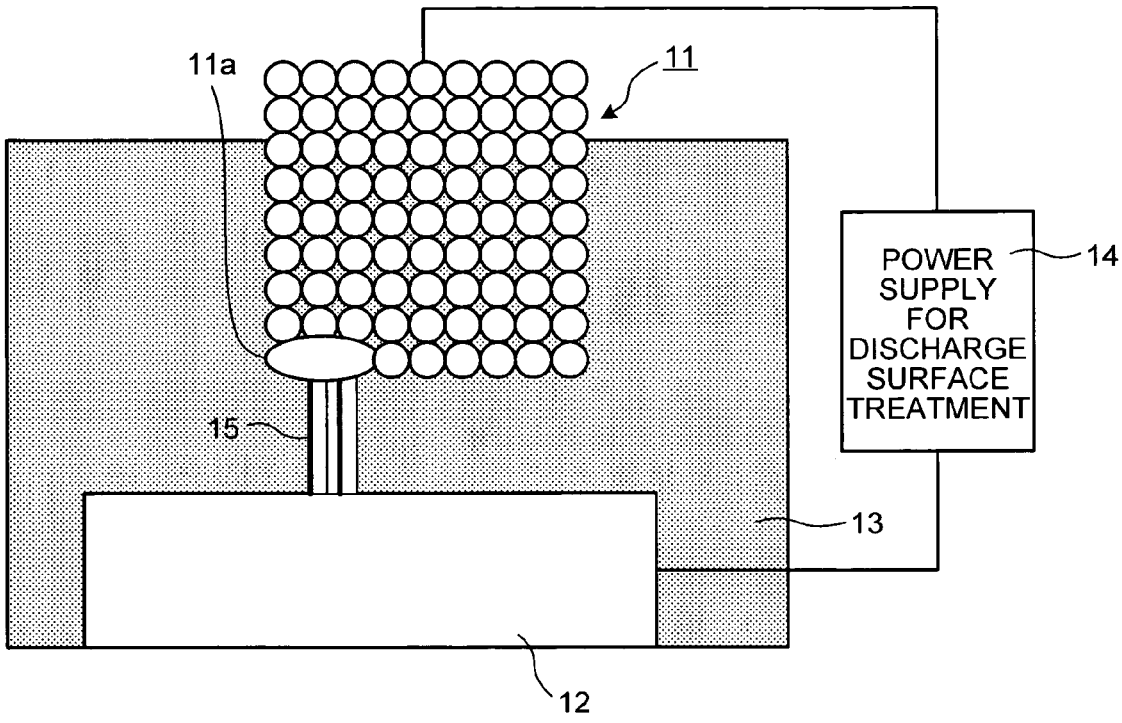
FIG. 6 is a schematic for illustrating a state in which a part of the electrode is melted by overheat.

A reason for this phenomenon is as follows. If a machining state, i.e., a treatment state of the discharge surface treatment turns unstable, a part of the electrode 11 is heated by a discharge heat due to a discharge concentration, and a molten and resolidified part 11*a* is generated as shown in FIG. 6. If an electric resistance of the molten and resolidified part 11*a* is reduced, the voltage detected by the voltage detecting device 14*b* is reduced by as much as the voltage drop of the electrode 11.

Figure 5A:
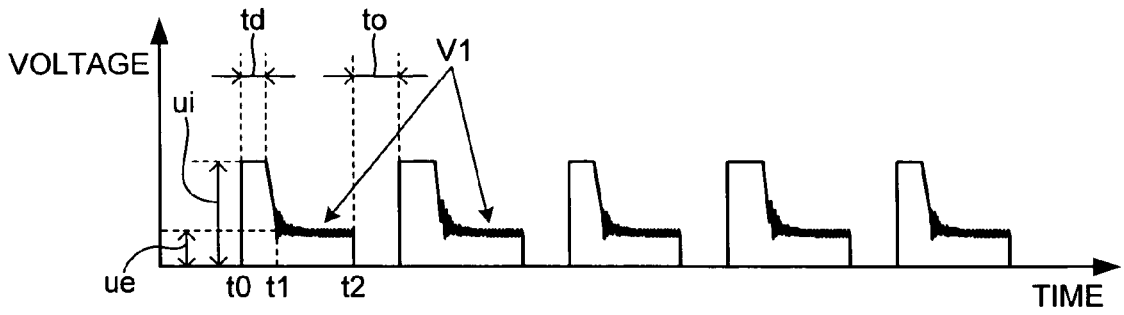
FIG. 5A is a graph of a voltage waveform when the discharge surface treatment is abnormally performed.
Figure 5B:
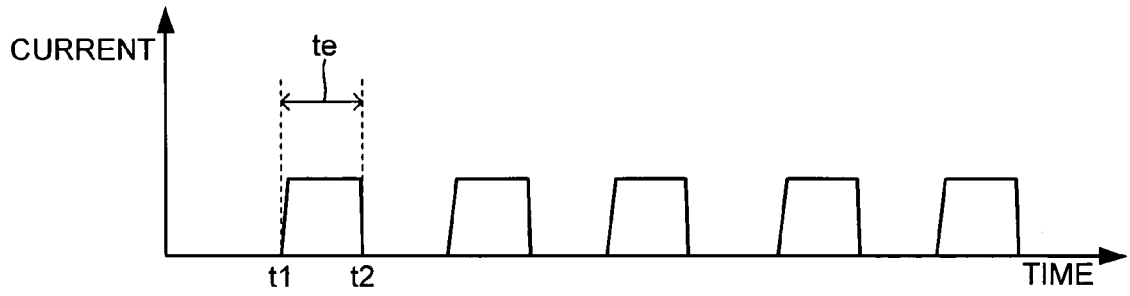
FIG. 5B is a graph of a current waveform corresponding to the voltage waveform shown in FIG. 5A.

In FIG. 5A, all pulse-like discharge voltages are reduced. If the machining (discharge surface treatment) turns unstable suddenly, a mixture of pulses having low discharge voltages and pulses having high discharge voltages is often present particularly at an initial stage.

In either case, if such an unstable phenomenon occurs to the discharge surface treatment, the molten and resolidified part 11*a* is generated by an overheat in the part of the electrode 11 as shown in FIG. 6. An experiment conducted by the inventor of the present invention shows that the discharge voltage is reduced if a discharge is generated in the molten and resolidified part 11*a*.

If such a state occurs, then the molten and resolidified part 11*a* of the electrode 11 turns similar to a solid electrode, the electric resistance is reduced, the discharge tends to be generated at the same position, and damage on the electrode is expanded.

Considering this, according to the present invention, the voltage detecting device 14*b* shown in FIG. 3 detects that the voltage between the electrode 11 and the workpiece 12 during the discharge is lower than the voltage during a stable machining, i.e., when the discharge surface treatment is performed stably. For example, a method for generating a pulse at a timing of detecting the voltage between the anode and the cathode after a passage of a predetermined time since the discharge is generated, and for comparing the voltage between the anode and the cathode with a threshold, which is a voltage on a boundary state between the stable machining and the unstable machining, at a timing of the pulse may be considered. The detection timing may be a predetermined time after the discharge is generated, such as 1 microsecond to several microseconds. Alternatively, the detection timing may be a middle of a discharge duration. The voltage detecting device 14*b* transmits a predetermined signal, such as a voltage detection result signal, to the control circuit 14*c*. The control circuit 14*c* determines whether the discharge state is normal based on the detection result of the voltage detecting device 14*b*. If it is determined that the discharge state is abnormal (bad), the control circuit 14*c* further turns off the switching element S1 or S2, for example, based on the determination result, thereby completely stopping generation of the discharge.

With this arrangement, the unstable phenomenon in the discharge surface treatment can be accurately detected, and appropriate measures can be taken before the electrode state is worsened due to the unstable phenomenon. That is, by discriminating a stability of the discharge surface treatment, it is possible to prevent the electrode from being damaged.

According to the present embodiment, an example in which the control circuit 14*c* includes a function of determining whether the discharge state is normal based on the detection result of the voltage detecting device 14*b* has been explained. Alternatively, a unit that includes the function of determining whether the discharge state is normal based on the detection result of the voltage detecting device 14*b* may be provided separately from the control circuit 14*c*.

The timing of detecting the voltage between the electrode 11 and the workpiece 12 may be timing selected during the discharge duration or may be a timing at which an average voltage is applied between the electrode 11 and the workpiece 12 during the discharge duration.

The voltage between the electrode 11 and the workpiece 12 during the stable machining depends on the type of the electrode to be used. The voltage is substantially constant according to each type of the electrode. Therefore, it suffices that the threshold is set to be lower than the voltage set by measurement in advance, and that the discharge state is determined unstable if the voltage falls below this threshold.

A circuit that calculates an average voltage during a discharge of a certain number of pulses may be arranged so as to determine that the discharge state is abnormal if a discharge in which the voltage is lower than the average calculated by this circuit by as much as a certain ratio, such as 10% is generated.

The following simpler method can be adopted. For example, if the electrode consists of metal and does not cause a voltage drop, the voltage between the anode and the cathode, i.e., the voltage between the electrode and the workpiece during the discharge surface treatment falls within a range of about 25 to 30 volts. If the voltage is, for example, equal to or higher than 35 volts, it can be determined that the discharge state is normal.

To prevent the electrode 11 from being damaged, it is also effective to change the discharge conditions such as extension of the discharge quiescent time "to" besides to completely stop generation of the discharge as explained above. For example, to extend the discharge quiescent time "to" to prevent the electrode 11 from being damaged, the discharge quiescent time 'to' may be extended to be twice from the next pulse when a pulse at which the discharge voltage falls below the threshold is generated.

If the discharge quiescent time 'to' is too long, an operation of a servo that controls a distance between the anode and the cathode turns unstable (this is because a control interval is longer since the servo controls the distance approximately per discharge pulse). Preferably, therefore, a certain upper limit (e.g., about 1 microsecond) of the discharge quiescent time 'to' is set.

A technique for preventing the electrode from being damaged if the coating is formed by the discharge surface treatment has been explained so far. Following points are found from the result of an experiment conducted for the present invention. During the stable machining, i.e., while the discharge surface treatment is performed stably, the voltage drop of the electrode that causes a rise in the discharge voltage occurs not to the whole electrode but to a bottom of the arc column on the surface of the electrode.

This is based on the following estimation. If the current flows to the interior of the electrode, the current flows in a wide range. The current flows to a very narrow part of the arc column, so that the electric resistance is higher in this part. This can be confirmed from the fact that the voltage drop of the electrode is reduced when a discharge is generated in the part of the electrode, which part is molten and resolidified and the electric resistance of which is partially reduced.

If the discharge voltage is suddenly out of the predetermined range in the discharge surface treatment, it can be determined that the electrode has turned abnormal during the discharge surface treatment. If the discharge voltage is always out of the predetermined range, it can be determined that the electrode is in an abnormal state from the beginning. The reason for this determination is as follows. If an electrode manufactured to be in a normal state is employed, the discharge voltage falls within the predetermined range. If the discharge voltage is always out of the predetermined range (the discharge voltage either exceeds the predetermined range or falls below the predetermined range), it can be determined that the electrode is in the abnormal state from the beginning.

If the discharge voltage is thus suddenly out of the predetermined range during the discharge surface treatment, it is determined that the electrode has turned abnormal in the middle of the discharge surface treatment. If the discharge voltage is always out of the predetermined range, it is determined that the electrode is in the abnormal state from the beginning. By so determining, it is possible to prevent the electrode and the coating from being damaged by the concentration of the discharge at the moment of the determination. It is, therefore, possible to effectively prevent the damage on the electrode.

It is necessary to melt the electrode material and move the molten electrode material toward the workpiece in the discharge surface treatment. To do so, the electrode must be kept in a state in which the electric resistance is high to some extent. If an abnormal state such as a concentrated generation of the discharge on a local part of the electrode occurs during the discharge surface treatment, melting of the part of the electrode, that is, the part on which the discharge concentrates is accelerated. If so, the electric resistance of the electrode is reduced. Such a change in the state of the electrode can be detected based on the discharge voltage, i.e., (an arc potential between the anode and the cathode)+(the voltage drop of the electrode).

The state in which the discharge voltage is reduced (state in which the voltage drop due to the resistance of the electrode is small) indicates that an abnormality has occurred to the electrode. At a timing of discharging a few pulses, the phenomenon can be detected.

Differently from a discharge removal machining, if the coating is formed on the surface of the workpiece by the discharge surface treatment, it is extremely difficult to restore the coating to the normal state from the abnormal state. This is because if the coating cannot be formed favorably and is dented, dents cannot be straightened out even by a continuous discharge surface treatment. The only way to restore the coating in which the dents are formed to the favorable state is to remove the dents and perform an additional treatment.

However, if the processing such as the extension of the quiescent time of the discharge pulse is executed at an initial stage of the state in which the formation of the coating turns unstable, it is sometimes possible to restore the coating to the stable state. Namely, if the discharge surface treatment turns unstable, it is necessary to accurately detect the unstable phenomenon in the coating formation, and to take appropriate measures before the state of the coating is worsened due to the unstable phenomenon.

According to the present invention, it is possible to accurately detect the unstable phenomenon in the discharge surface treatment, and to take appropriate measures before the formation state of the coating is worsened due to the unstable phenomenon. In other words, by discriminating the stability of the discharge surface treatment, it is possible to prevent the coating formation state from being worsened.

Furthermore, according to the present invention, therefore, it is possible to accurately detect the suddenly occurring unstable phenomenon in the coating formation, and to take appropriate measures before the state of the coating and the state of the electrode are worsened due to the unstable phenomenon. In other words, by discriminating the stability of the discharge surface treatment, it is possible to prevent the coating formation state and the electrode from being damaged.

An example in which the discharge surface treatment is performed in the machining fluid has been explained in this embodiment. However, the present invention is not limited to the example of performing the discharge surface treatment in the machining fluid. The present invention is also applicable to performing the discharge surface treatment under a gas atmosphere.

INDUSTRIAL APPLICABILITY

As explained so far, the discharge surface treatment method according to the present invention is suited to be used in surface treatment related industries for forming a coating on a surface of a workpiece, particularly in surface treatment related industries for forming a thick coating on the surface of the workpiece.

The invention claimed is:

1. A discharge surface treatment method for generating a pulse-like discharge between an electrode and a workpiece, using a green compact formed by compressing any one of a metal powder, a metal compound powder, and a ceramics powder as the electrode, and forming a coating consisting either one of a material for the electrode and a material obtained from a reaction of the material for the electrode by a discharge energy of the pulse-like discharge on a surface of the workpiece, the discharge surface treatment method comprising:

detecting a voltage between the electrode and the workpiece during a discharge; and determining a state of the discharge surface treatment based on a result of the detecting, wherein the determining comprises determining that the state of the discharge surface treatment is abnormal if a drop of the voltage is detected at the detecting, and wherein the voltage drop is a small, predetermined percentage lower than the voltage between the electrode and the workpiece during the discharge when the discharge surface treatment is normal.

2. The discharge surface treatment method according to claim 1, wherein the determining the state of the discharge surface treatment based on the result of the detecting comprises detecting unstable phenomenon in coating formation, and wherein the detecting the voltage comprises adding a voltage drop of the electrode to an arc voltage.

3. The discharge surface treatment method according to claim 1, wherein the determining the state of the discharge surface treatment based on the result of the detecting comprises detecting a start of an unstable phenomenon in coating formation, and wherein the detecting the voltage comprises calculating average voltage during a discharge of a predetermined number of pulses.

4. The discharge surface treatment method according to claim 1, wherein the drop of the voltage comprises at least ten percent lower than the voltage between the electrode and the workpiece during the discharge when the discharge surface treatment is normal or approximately between five to ten volts lower than the voltage between the electrode and the workpiece during the discharge when the discharge surface treatment is normal.

5. A discharge surface treatment method for generating a pulse-like discharge between an electrode and a workpiece, using a green compact formed by compressing any one of a metal powder, a metal compound powder, and a ceramics powder as the electrode, and forming a coating consisting either one of a material for the electrode and a material obtained from a reaction of the material for the electrode by a discharge energy of the pulse-like discharge on a surface of the workpiece, the discharge surface treatment method comprising:

detecting a voltage between the electrode and the workpiece during a discharge; and determining a state of the electrode based on a result of the detecting, wherein the determining comprises determining if the electrode that provides a coat on the workpiece has become molten.

6. The discharge surface treatment method according to claim 5, wherein the determining comprises determining that the electrode is resolidified if the voltage is out of a predetermined range.

7. The discharge surface treatment method according to claim 5, wherein the determining the state of the electrode based on a result of the detecting comprises detecting unstable phenomenon in coating formation.

8. A discharge surface treatment apparatus for generating a pulse-like discharge between an electrode and a workpiece, using a green compact formed by compressing any one of a metal powder, a metal compound powder, and a ceramics powder as the electrode, and forming a coating consisting either one of a material for the electrode and a material obtained from a reaction of the material for the electrode by a discharge energy of the pulse-like discharge on a surface of the workpiece, the discharge surface treatment apparatus comprising:

a voltage detecting unit that detects a voltage between the electrode and the workpiece during a discharge; and a state determining unit that determines a state of the discharge based on a result of detection by the voltage detecting unit, wherein the determining by the state determining unit comprises determining that the state of the discharge surface treatment is abnormal if a drop of the voltage is detected at the detecting, and wherein the voltage drop is a small, predetermined percentage lower than the voltage between the electrode and the workpiece during the discharge when the discharge surface treatment is normal.

9. The discharge surface treatment apparatus according to claim 8, further comprising:

a control unit that stops the discharge or changes a condition for the discharge surface treatment based on the result of detection by the voltage detecting unit.

10. The discharge surface treatment apparatus according to claim 8, wherein the electrode contains a material that hardly forms a carbide as much as 40 volume % or more.

11. The discharge surface treatment apparatus according to claim 8, wherein the voltage detecting unit that detects the voltage between the electrode and the workpiece is based on resistors with a preset resistance.

12. The discharge surface treatment apparatus according to claim 11, wherein the voltage detecting unit that detects the voltage between the electrode and the workpiece is based on switching elements connected to the resistors, wherein the voltage is applied between the workpiece and the electrode by the switching elements, and wherein the resistance in the resistors is preset based on a type of the electrode.

13. The discharge surface treatment apparatus according to claim 8, wherein the voltage detecting unit detects a reduced voltage between the electrode and the workpiece during the discharge, wherein the reduced voltage comprises at least ten percent lower than the voltage between the electrode and the workpiece during the discharge when the discharge surface treatment is normal or approximately between five to ten volts lower than the voltage between the electrode and the workpiece during the discharge when the discharge surface treatment is normal.

14. A discharge surface treatment apparatus for generating a pulse-like discharge between an electrode and a workpiece, using a green compact formed by compressing any one of a metal powder, a metal compound powder, and a ceramics powder as the electrode, and forming a coating consisting either one of a material for the electrode and a material obtained from a reaction of the material for the electrode by a discharge energy of the pulse-like discharge on a surface of the workpiece, the discharge surface treatment apparatus comprising:

a voltage detecting unit that detects a voltage between the electrode and the workpiece during a discharge; and a state determining unit that determines a state of the electrode based on a result of detection by the voltage detecting unit, wherein the determining by the state determining unit comprises determining if the electrode that provides a coat on the workpiece has become molten.

15. The discharge surface treatment apparatus according to claim 14, wherein the state determining unit determines that the state of the electrode is abnormal if the voltage is out of a predetermined range.

16. The discharge surface treatment apparatus according to claim 14, wherein the electrode contains a material that hardly forms a carbide as much as 40 volume % or more.

17. The discharge surface treatment apparatus according to claim 14, wherein the determining the state of the electrode by the state determining unit is based on the result of detecting a resolidified part in the electrode.

18. A discharge surface treatment method for generating a pulse-like discharge between an electrode and a workpiece, and forming a coating consisting either one of a material for the electrode and a material obtained from a reaction of the material for the electrode by a discharge energy of the pulse-like discharge on a surface of the workpiece, the discharge surface treatment method comprising:

detecting a voltage between the electrode and the workpiece at a predetermined time after a discharge is generated; and determining a state of the electrode based on a result of the detecting; and determining whether the electrode has turned abnormal during the discharge surface treatment wherein the determining whether the electrode has turned abnormal comprises determining if the electrode that provides a coat on the workpiece has become molten.

19. The discharge surface treatment method according to claim 18, wherein the determining the state of the electrode based on the result of the detecting comprises detecting an unstable phenomenon prior to damage to the coating formation.

20. The discharge surface treatment method according to claim 18, wherein the discharge surface treatment is performed in machining fluid or under a gas atmosphere.

* * * * *